US012233307B2

(12) United States Patent
Kang et al.

(10) Patent No.: US 12,233,307 B2
(45) Date of Patent: Feb. 25, 2025

(54) VARIABLE EXERCISE APPARATUS

(71) Applicant: LG ELECTRONICS INC., Seoul (KR)

(72) Inventors: Won Seok Kang, Seoul (KR); Se Young Woo, Seoul (KR); Jeong Joon Roh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 253 days.

(21) Appl. No.: 17/790,858

(22) PCT Filed: Jan. 7, 2021

(86) PCT No.: PCT/KR2021/000161
§ 371 (c)(1),
(2) Date: Apr. 25, 2023

(87) PCT Pub. No.: WO2021/141393
PCT Pub. Date: Jul. 15, 2021

(65) Prior Publication Data

US 2023/0310922 A1 Oct. 5, 2023

(30) Foreign Application Priority Data

Jan. 7, 2020 (KR) ..... 10-2020-0002230

(51) Int. Cl.
*A63B 21/00* (2006.01)
*A63B 21/005* (2006.01)
*A63B 71/06* (2006.01)

(52) U.S. Cl.
CPC ..... *A63B 21/156* (2013.01); *A63B 71/0622* (2013.01); *A63B 21/0058* (2013.01);
(Continued)

(58) Field of Classification Search
CPC ..... A63B 21/062; A63B 21/0626; A63B 21/0628; A63B 21/15; A63B 21/151;
(Continued)

(56) References Cited

U.S. PATENT DOCUMENTS 4,402,504 A * 9/1983 Christian ..... A63B 21/156 482/129
4,898,381 A 2/1990 Gordon
(Continued)

FOREIGN PATENT DOCUMENTS

JP 2004-520897 7/2004
KR 20-0385444 5/2005
(Continued)

OTHER PUBLICATIONS

International Search Report dated Apr. 21, 2021 issued in Application No. PCT/KR2021/000161.
(Continued)

*Primary Examiner* — Zachary T Moore
(74) *Attorney, Agent, or Firm* — KED & ASSOCIATES, LLP

(57) ABSTRACT

Provided is a variable exercise apparatus including a main body part that is polygonal prismatic, and includes a driving part configured to generate an exercise load, a first side frame that is arranged to be accommodated in or drawn out from the main body part, and configured to rotate with respect to the main body part when drawn out from the main body part, and a second side frame that is arranged to be symmetric with the first side frame about the main body part, wherein the first side frame includes a first handle adjustment pillar that is arranged in a vertical direction, and a first handle configured to move along the first handle adjustment pillar.

13 Claims, 14 Drawing Sheets

(52) U.S. Cl.
CPC . *A63B 2071/0636* (2013.01); *A63B 2220/806* (2013.01); *A63B 2225/09* (2013.01); *A63B 2225/12* (2013.01)

(58) Field of Classification Search
CPC ..... A63B 21/154; A63B 21/156; A63B 2220/806; A63B 2225/09; A63B 2225/12
See application file for complete search history.

(56) References Cited

U.S. PATENT DOCUMENTS

| | | | | |
|---|---|---|---|---|
| 6,447,430 | B1 * | 9/2002 | Webb | A63B 23/00 482/93 |
| D812,156 | S * | 3/2018 | Stoyanov Kichev | D21/675 |
| 9,968,819 | B2 * | 5/2018 | Hockridge | A63B 23/03541 |
| D1,019,825 | S * | 3/2024 | Tao | D21/673 |
| 2002/0091043 | A1 * | 7/2002 | Rexach | A63B 21/0628 482/99 |
| 2005/0202941 | A1 * | 9/2005 | Vaes | A63B 21/0628 482/94 |
| 2007/0037674 | A1 * | 2/2007 | Finn | A63B 21/0628 482/99 |
| 2009/0181833 | A1 * | 7/2009 | Cassidy | A63B 21/156 482/92 |
| 2013/0274075 | A1 * | 10/2013 | Habing | A63B 21/0628 482/102 |
| 2014/0080619 | A1 * | 3/2014 | Heddleston | A63B 69/3667 473/409 |
| 2017/0056705 | A1 * | 3/2017 | Zha | A63B 21/4035 |
| 2020/0323339 | A1 * | 10/2020 | Sierra Murillo | A47B 23/06 |
| 2020/0353312 | A1 * | 11/2020 | Smith | A61B 5/7405 |

FOREIGN PATENT DOCUMENTS

| | | |
|---|---|---|
| KR | 10-2014-0045763 | 4/2014 |
| KR | 10-1394117 | 5/2014 |
| KR | 10-2019-0061152 | 6/2019 |
| WO | WO 2019/014558 | 1/2019 |
| WO | WO 2019/100117 | 5/2019 |

OTHER PUBLICATIONS

European Search Report dated Dec. 14, 2023 issued in Application No. 21738584.8.
Korean Office Action dated Aug. 27, 2024 issued in Application No. 10-2020-0002230.

* cited by examiner

VARIABLE EXERCISE APPARATUS

CROSS-REFERENCE TO RELATED PATENT APPLICATIONS

This application is a U.S. National Stage Application under 35 U.S.C. § 371 of PCT Application No. PCT/KR2021/000161, filed Jan. 7, 2021, which claims priority to Korean Patent Application No. 10-2020-0002230, filed Jan. 7, 2020, whose entire disclosures are hereby incorporated by reference.

TECHNICAL FIELD

This disclosure relates a variable exercise apparatus that may be used for exercising various body parts and changes its shape to occupy less space.

BACKGROUND ART

In general, a device used for strength training is designed to repeat muscle relaxation and contraction while pushing or pulling a lever connected to a weight of a fixed unit of weight.

Among the equipment for strength training, there are various exercise equipment such as an arm curl device for biceps exercise, chest press or butterfly workout devices for chest muscles such as pectoralis major, and a pull up device for back muscle exercise.

However, each of these exercise devices are too bulky and heavy, so it is difficult to secure an arrangement space, and there is a problem of exposure to injury when adjusting the weight to control the exercise load.

Therefore, research is being conducted for exercise equipment for exercising various muscle areas with one instrument and for safely controlling exercise load, and yet still having excellent space utilization.

DISCLOSURE OF INVENTION

Technical Goals

In order to solve the above-mentioned existing problems, an aspect provides a variable exercise apparatus for safely controlling exercise load without adjusting the weight.

An aspect provides a variable exercise apparatus of which shape is varied for workout of various muscle parts even within a limited space.

An aspect provides a variable exercise apparatus having an advantageous shape to secure arrangement space.

Technical Solutions

According to an aspect, there is provided a variable exercise apparatus including a main body part that is polygonal prismatic, and includes a driving part configured to generate an exercise load, a first side frame that is arranged to be accommodated in or drawn out from the main body part, and configured to rotate with respect to the main body part when drawn out from the main body part, and a second side frame that is arranged to be symmetric with the first side frame about the main body part, wherein the first side frame includes a first handle adjustment pillar that is arranged in a vertical direction, and a first handle configured to move along the first handle adjustment pillar.

Further, the first side frame may be configured to be drawn out from or accommodated in the main body part by sliding.

Further, the first side frame may include a first fixing part configured to fix the first side frame by preventing the sliding with respect to the main body part.

Further, the first side frame may include a second fixing part configured to fix the first side frame by preventing rotating with respect to the main body part.

Further, the main body part may be a cross-sectional shape that is in a form of a right isosceles triangle, and the first side frame and the second side frame may be drawn out or accommodated in along both edges forming a right angle at a vertex portion forming an acute angle.

Further, the first side frame and the second side frame, when drawn out from the main body part, may rotate to approach each other or move away from each other.

Further, the first side frame may further include a pull up handle that is rotatable about the first handle adjustment pillar, and projects from or is accommodated in the first side frame.

Further, the first handle adjustment pillar may include a plurality of joining holes formed at equal intervals in a longitudinal direction, and the first handle may include a joining protrusion that is projected toward the first handle adjustment pillar or accommodated.

Further, the plurality of joining holes may be formed on an outer peripheral surface of the first handle adjustment pillar to be spaced apart from each other in a circumferential direction of the first handle adjustment pillar.

Further, the first handle may include a handle body that is inserted into the first handle adjustment pillar to move, a handle adjusting part that is installed on the handle body to insert or draw the joining protrusion into the joining holes, and a pulley part that projects from the handle body and is connected to the driving part of the main body part to receive an exercise load.

Further, the handle adjusting part and the pulley part may be arranged in opposite directions to each other with respect to the handle body, and the first handle may further include a first gripping part connected to the driving part of the main body part through the pulley part.

Further, the main body part may further include a camera that is arranged between the first side frame and the second side frame.

Further, the main body part may further include a one-way transparent mirror arranged on a surface between the first side frame and the second side frame.

Further, the main body part may further include a display that is arranged on a rear surface of the one-way transparent mirror.

Effects

According to example embodiments, the variable exercise apparatus utilizes a motor and a reducer, and allows a user to control them, thereby avoiding the risk of adjusting the weight and adjusting the exercise loads.

According to example embodiments, as the first side frame and the second side frame slide and move, the variable exercise apparatus may change its shape so that a user may exercise a desired muscle part.

According to example embodiments, the variable exercise apparatus has a form that is easy to be installed in a corner of a space, and when the variable exercise apparatus is not used, it may be transformed into a form that minimizes the volume.

BEST MODE FOR CARRYING OUT THE INVENTION

Figure 1:
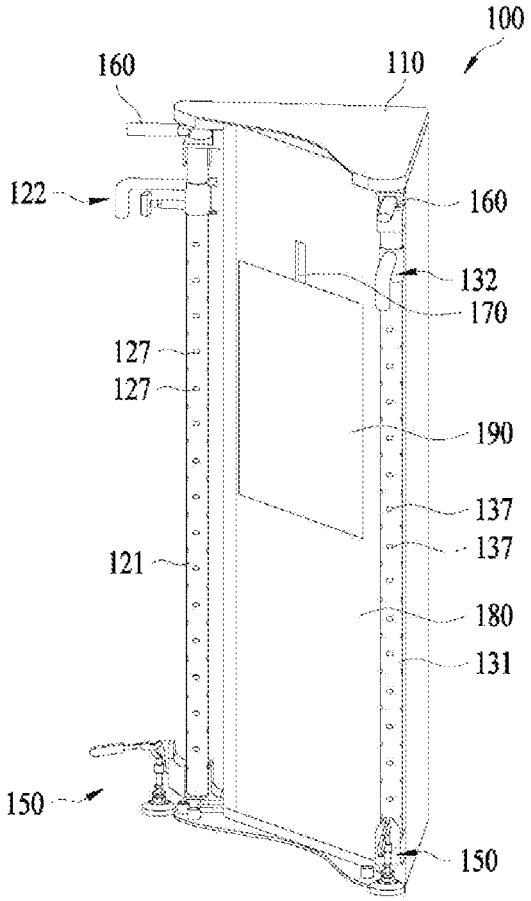
FIG. 1 is a perspective view illustrating a first state of a variable exercise apparatus according to an example embodiment of the present disclosure.

Hereinafter, exemplary embodiments disclosed in the present specification will be described in detail with reference to the accompanying drawings, but identical or similar elements are denoted by the same reference numerals regardless of drawing numbers, and redundant descriptions thereof will be omitted. The suffixes "module" and "unit" for components used in the following description are given or used interchangeably in consideration of only the ease of preparation of the specification, and do not have meanings or roles that are distinguished from each other. In addition, in describing the embodiments disclosed in the present specification, when it is determined that a detailed description of related known technologies may obscure the gist of the embodiments disclosed in the present specification, the detailed description thereof will be omitted. In addition, the accompanying drawings are for easy understanding of the embodiments disclosed in the present specification, but the technical idea disclosed in the present specification is not limited by the accompanying drawings, and it should be understood to include all modifications, equivalents, or substitutes included in the spirit and scope of the present disclosure.

Terms including an ordinal number such as first and second may be used to describe various elements, but the elements are not limited by the terms. These terms are used only for the purpose of distinguishing one component from another component.

When a component is referred to as being "coupled" or "connected" to another component, it should be understood that it may be directly coupled or connected to the other component, but other components may exist in the middle. On the other hand, when a component is referred to as being "directly coupled" or "directly connected" to another component, it should be understood that there is no other component in the middle.

Singular expressions include plural expressions unless the context clearly indicates otherwise.

In the present application, terms such as "comprise" or "have" are intended to designate the presence of features, numbers, steps, actions, components, parts, or combinations thereof described in the specification, but it is to be understood that it does not preclude in advance the possibility of the presence or addition of one or more other features, numbers, steps, actions, components, parts, or combinations thereof.

Figure 2:
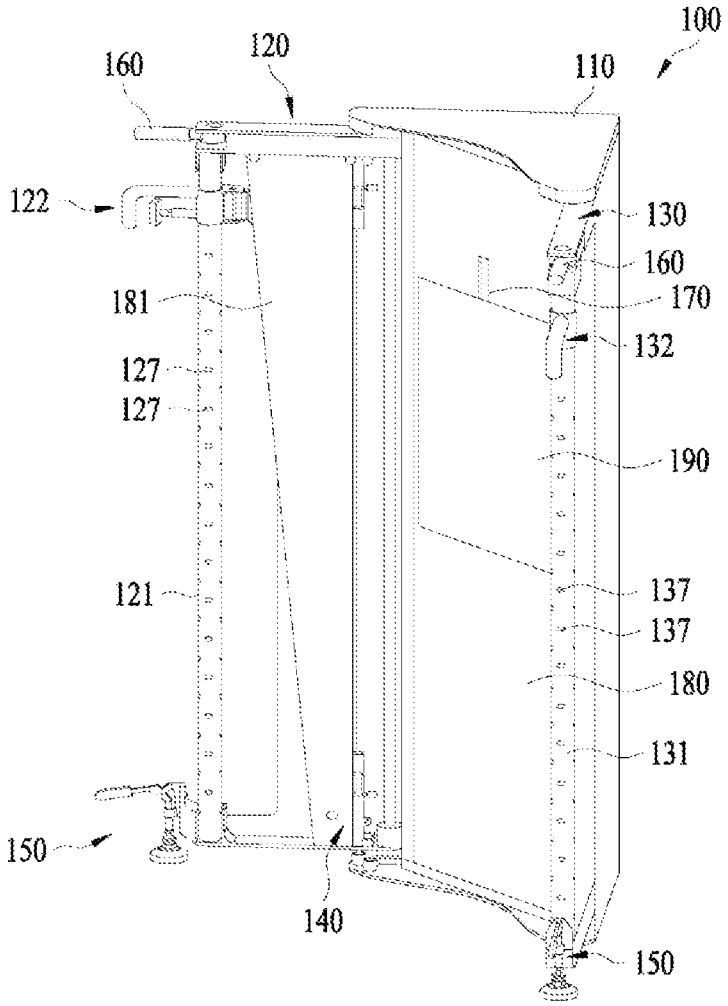
FIG. 2 is a perspective view illustrating a second state of a variable exercise apparatus according to an example embodiment of the present disclosure.
Figure 3:
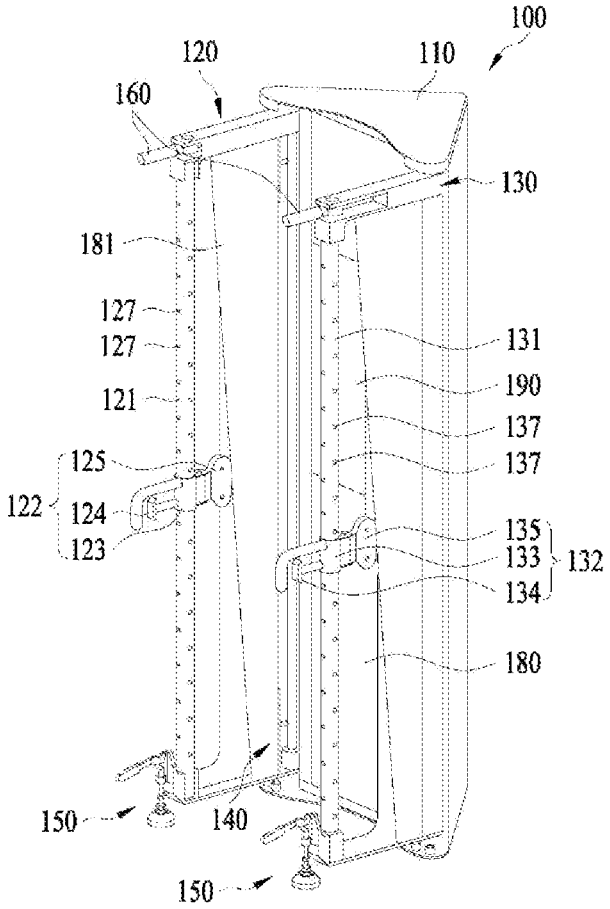
FIG. 3 is a perspective view illustrating a third state of a variable exercise apparatus according to an example embodiment of the present disclosure.
Figure 4:
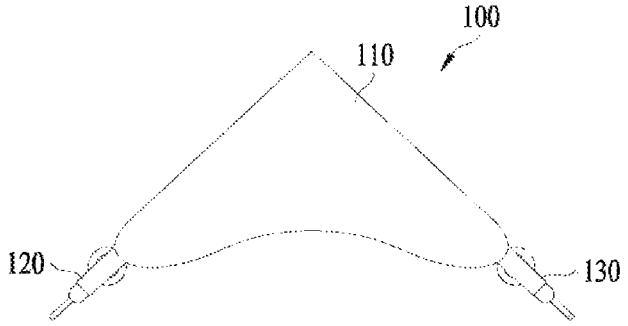
FIG. 4 is a plan view illustrating the first state of the variable exercise apparatus according to an example embodiment of the present disclosure.
Figure 5:
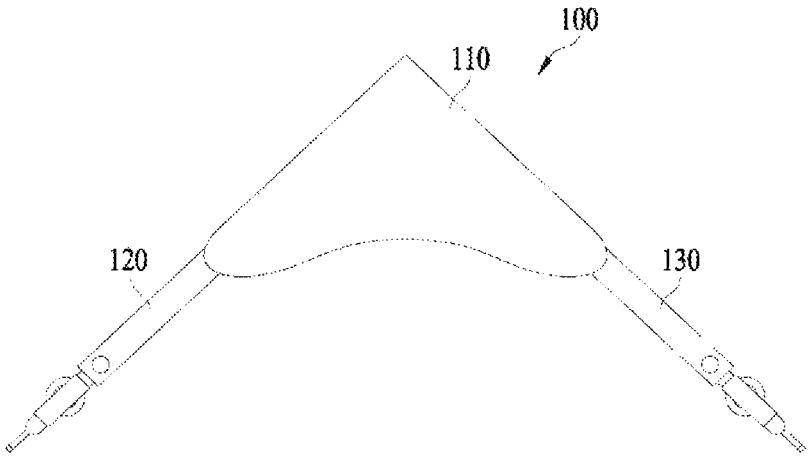
FIG. 5 is a plan view illustrating the second state of the variable exercise apparatus according to an example embodiment of the present disclosure.
Figure 6:
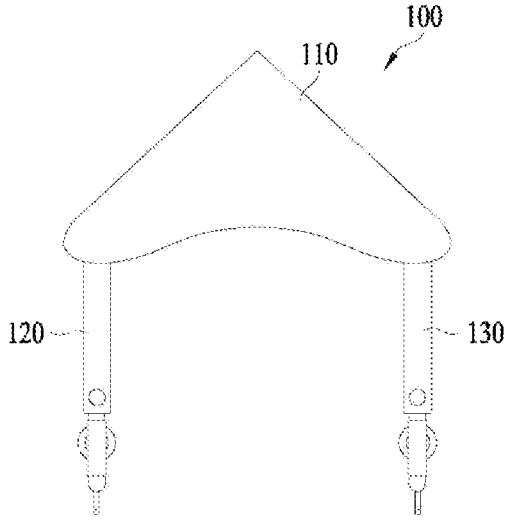
FIG. 6 is a plan view illustrating the third state of the variable exercise apparatus according to an example embodiment of the present disclosure.

FIGS. 1 to 3 are perspective views illustrating various operating states of a variable exercise apparatus 100 according to the example embodiments, and FIGS. 4 to 6 are plan views illustrating various operating states of the variable exercise apparatus 100 according to the example embodiments.

More specifically, FIG. 1 is a perspective view illustrating the first state of the variable exercise apparatus 100 according to the example embodiment, FIG. 2 is a perspective view illustrating the second state, and FIG. 3 is a perspective view illustrating the third state.

FIG. 4 is a plan view illustrating the first state of the variable exercise apparatus 100 according to the example embodiment of the present disclosure, FIG. 5 is a plan view illustrating the second state, and FIG. 6 is a plan view illustrating the third state.

In explaining the variable exercise apparatus 100 according to the example embodiments, directions may be defined and used to help understanding. For example, the front is a direction facing a user and may indicate a direction toward the lower left side based on the illustrated state of FIG. 1. The rear may indicate a direction opposite to the front. The left direction is a direction parallel to the ground and perpendicular to the front, and may indicate the upper left with respect to the illustrated state of FIG. 1. The right direction may indicate a direction opposite to the left direction. An upward direction is a direction perpendicular to the ground, and may indicate upward based on the illustrated state of FIG. 1. A downward direction may indicate a direction opposite to the upward direction.

The above direction definitions are intended to help the understanding of the present disclosure, and are not absolute. When any one-direction reference is changed, the other direction references may also be changed in response thereto.

Referring to FIGS. 1 to 6, the variable exercise apparatus 100 according to an example embodiment of the present disclosure may include a main body part 110, a first side frame 120 and a second side frame 130.

The main body part 110 according to the example embodiment of the present disclosure may be polygonal prismatic having an internal space. For example, as illustrated in FIGS. 1 to 3 or in FIGS. 4 to 6, the main body part 110 may have a triangular prism shape having a cross section in the form of a right isosceles triangle. The main body part 110 may be arranged such that a portion forming a right angle of the right isosceles triangle is located at the rear. When arranging the variable exercise apparatus 100 in an indoor space, when the rear surface of the main body part 110 is positioned at the edge of the space, the utilization of the space may be maximized.

The main body part 110 according to an example embodiment may have an internal space, so that various parts may be embedded therein, and the main body part 110 may serve as a center of gravity for supporting the variable exercise apparatus 100 by embedding particularly heavy components. For example, inside the main body part 110, a driving part (not illustrated) that generates exercise load may be included. The driving part may include such as a motor, a speed reducer and a pulley for transmitting an exercise load of the driving part, for example. Since the motor, the speed reducer and the pulley are mainly made of metal and have a relatively heavy weight, they may be arranged inside the main body part 110 to serve as a center of gravity.

A camera 170, a mirror 180 and a display 190 may be arranged on the main body part 110 according to an example embodiment. More specifically, the mirror 180 may be arranged on the front side of the main body part 110. A user may recognize his/her movement while looking at the mirror 180 during the exercise process. The mirror 180 according to an example embodiment may be a one-way transparent mirror 180, and the display 190 may be arranged on the rear surface of the mirror. The one-way transparent mirror 180 may indicate a mirror that acts like a transparent glass in one direction, but acts like a mirror in the other direction. Further, the one-way transparent mirror 180 may indicate a mirror formed so that, when a light source is present in one direction, the light source may be recognized even when viewed from the other direction.

For example, the one-way transparent mirror 180 may be installed on the main body part 110 so that a user may see it from the other direction, and the display 190 may be arranged in one direction of the one-way transparent mirror 180. When the display 190 is not in user, the one-way transparent mirror 180 acts the same as a general mirror and thus, it may be utilized as a general mirror. In the case of using the display 190, since there is a light source generated from the display 190, the user may recognize the display 190 beyond the one-way transparent mirror 180. The camera 170 may be arranged on the front surface of the main body part 110 according to the example embodiment, toward the user. The user's exercise situation may be recognized through the camera 170, and feedback on an exercise movement may be provided through the display 190. Alternatively, after storing an image of the user's exercise, the image may be used in various ways, such as displaying the image on the display 190.

The mirror 181 may be arranged on the first side frame 120 and the second side frame 130 according to an example embodiment. For example, in the state illustrated in FIG. 2, a mirror may be arranged on a surface facing the front so that the user's appearance may be viewed from various angles. Further, the mirror 181 installed on the first side frame 120 and the second side frame 130 may be formed in a shape that is narrower at the bottom than at the top so that the shape of the mirror viewed from the front becomes an inverted trapezoid. Through this, by seeing the upper body with a wide range of exercise through a mirror with a large area, the user may easily grasp the state of his or her exercise.

The first side frame 120 and the second side frame 130 according to the example embodiment may be arranged to be accommodated in or drawn from the main body part 110. Referring to FIGS. 4 to 6, the first side frame 120 and the second side frame 130 may be arranged to be symmetrical on both sides with respect to the main body part 110. For example, if the first side frame 120 is arranged on the left side of the main body part 110, the second side frame 130 may be arranged on the right side of the main body part 110. As described above, since the first side frame 120 and the second side frame 130 are substantially the identical component, the description may be focused on the first side frame 120.

The first side frame 120 according to the example embodiment may be accommodated or projected while sliding along the left side of the main body part 110. For example, as illustrated in FIG. 4, the first side frame 120 may be accommodated in the internal space of the main body part 110. This state may be referred to as a first state. From the first state, as illustrated in FIG. 5, the frames may project by sliding along sides forming a right angle to each other in a portion forming an acute angle of an isosceles right triangle. In other words, as illustrated in FIG. 5, the first side frame 120 may project in a diagonal direction from the left side of the front of the main body part 110. This state may be referred to as a second state. Rails may be installed on the main body part 110 and the first side frame 120 to be slidably movable. Alternatively, the movement of the first side frame 120 may be guided according to the shapes of the protrusion and the groove. As described above, a constitution in which the main body part 110 and the first side frame 120 may slide with each other may be applied in various ways.

The first side frame 120 and the second side frame 130 according to another example embodiment may project from the main body part 110 and rotate vertically with respect to the main body part 110. For example, as illustrated in FIG. 6, the first side frame 120 and the second side frame 130 projected from the main body part 110 may rotate to be closer to each other. This state may be referred to as a third state. By rotating the first side frame 120 to be close to the second side frame 130, according to the user's body structure, a first handle 122 of the first side frame 120 and a second handle 132 of the second side frame 130 may be brought closer to each other.

The first side frame 120 according to an example embodiment may include a first handle adjustment pillar 121 and the first handle 122. Similarly, the second side frame 130 may include a second handle adjustment pillar 131 and the second handle 132. However, as described above, components of the first side frame 120 may be mainly described to help the understanding of the present disclosure.

The first handle adjustment pillar 121 according to the example embodiment may include joining holes 127 aligned in a straight line forming equal intervals in the longitudinal direction on the outer peripheral surface. For example, such a joining hole 127 may be referred to as a first row joining hole 127*a*. Further, the plurality of joining holes 127 aligned in a straight line may be formed on the peripheral surface of the first handle adjustment pillar 121 in the circumferential direction. For example, the first row joining hole 127*a* to a fourth row joining hole 127*d* may be arranged at intervals of 90° in the circumferential direction. The first row joining hole 127*a* and an adjacent second row joining hole 127*b* or a third row joining hole 127*c* may be formed to cross each other so as not to be formed at the same height.

Figure 7:
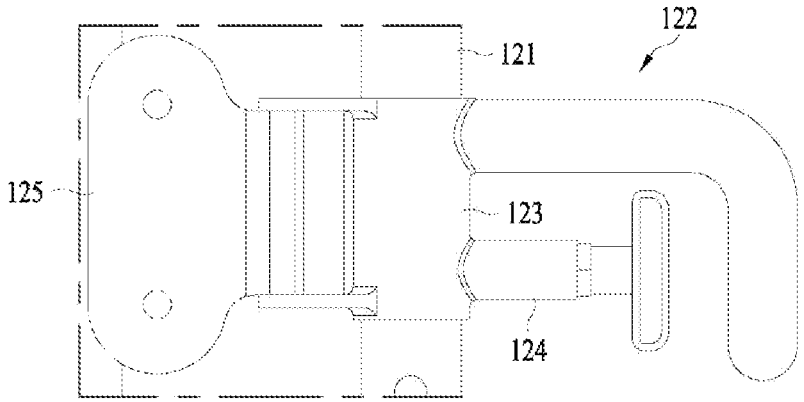
FIG. 7 is a view illustrating a state in which the handle of the variable exercise apparatus is fixed according to an example embodiment of the present disclosure.
Figure 8:
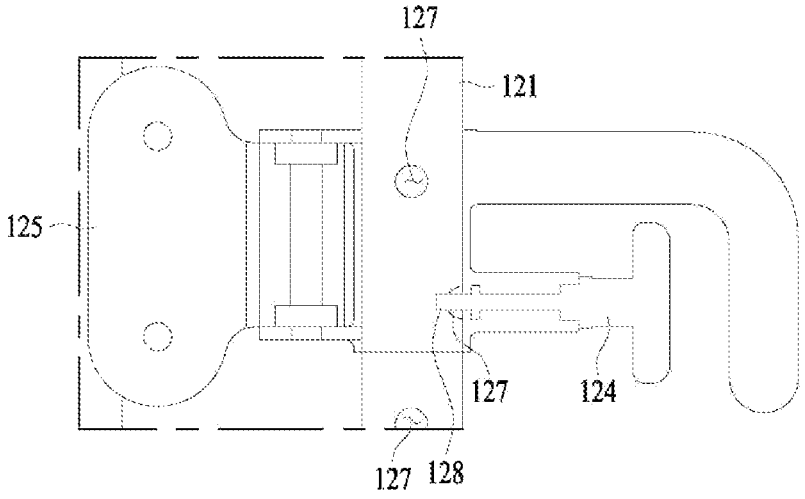
FIG. 8 is a view illustrating the inside of the variable exercise apparatus in a fixed state by cutting the handle according to an example embodiment of the present disclosure.

FIG. 7 is a view illustrating a state in which the handle of the variable exercise apparatus 100 is fixed according to an example embodiment of the present disclosure. FIG. 8 is a view illustrating the inside of the variable exercise apparatus 100 in a fixed state by cutting the handle according to an example embodiment of the present disclosure.

The first handle 122 according to the example embodiment may include a handle body 123, a handle adjusting part 124, a pulley part 125 and a first gripping part 126. Likewise, the second handle 132 may include a handle body 133, a handle adjusting part 134, a pulley part 135 and a second gripping part 136.

The handle body 123 according to the example embodiment may be inserted into the first handle adjustment pillar 121 in a pipe shape to move vertically along the first handle adjustment pillar 121. The handle adjusting part 124 according to the example embodiment may fix the handle body 123 to the first handle adjustment pillar 121. Specifically, the handle adjusting part 124 may be installed on the handle body 123 to allow a joining protrusion 128 to project toward the first handle adjustment pillar 121 or to be withdrawn. As the joining protrusion 128 projects and is inserted into the joining hole 127 of the first handle adjustment pillar 121, the handle body 123 may be fixed to the first handle adjustment pillar 121. Again, when the joining protrusion 128 is withdrawn by the handle adjusting part 124 and drawn out from the joining hole 127, the handle body 123 may move vertically along the first handle adjustment pillar 121 again. In this way, by adjusting the height of the first handle 122, the user's exercise part may be changed. The pulley part 125 may be arranged on the opposite side of the handle adjusting part 124 with respect to the handle body 123. The first handle 122 may correspond to a portion directly gripped by the user to perform the exercise. The first handle 122 may be connected to a driving part of the main body part 110 through a cable to receive an exercise load. The cable connected to the first handle 122 may be connected to the driving part through the pulley part 125, and the pulley part 125 may continuously and smoothly convert the transmission direction of the exercise load, so that the user may perform various exercise movements.

Figure 9:
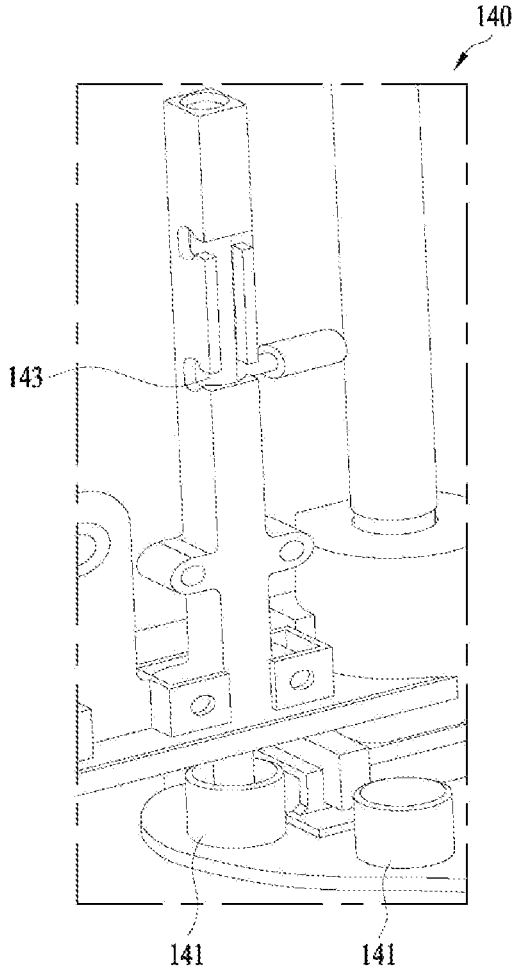
FIG. 9 is a view illustrating a first fixing part of the variable exercise apparatus according to an example embodiment of the present disclosure.
Figure 10:
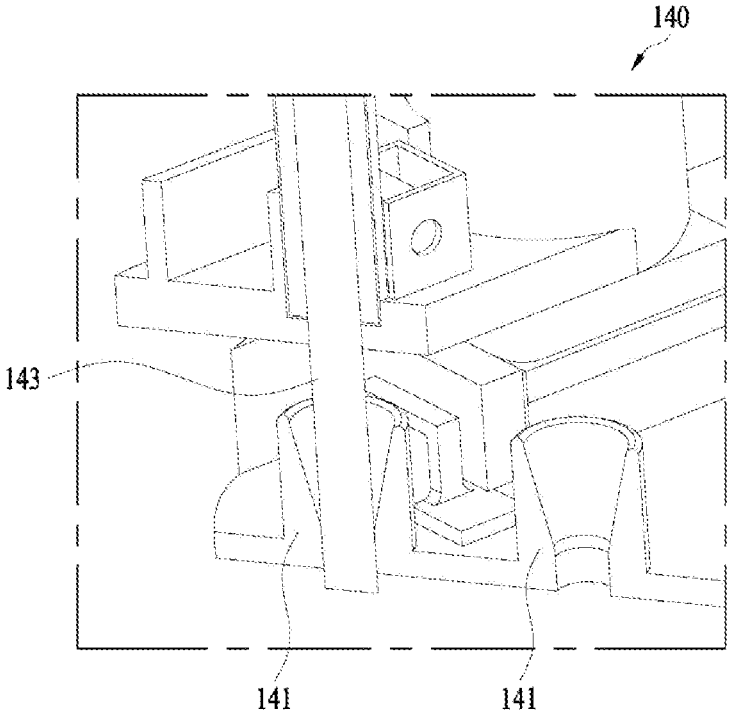
FIG. 10 is a cross-sectional view taken along A-A.

FIG. 9 is a view illustrating a first fixing part 140 of the variable exercise apparatus 100 according to an example embodiment of the present disclosure, and FIG. 10 is a cross-sectional view taken along A-A.

Regarding the variable exercise apparatus 100 according to the example embodiment, the first side frame 120 projects from the main body part 110, and a user may exercise by manipulating the first handle 122 arranged on the first side frame 120. In this case, the first side frame 120 may be fixed so that the user may stably exercise.

Therefore, in an example embodiment of the present disclosure, arranging the first fixing part 140 may prevent the first side frame 120 from sliding back to the main body part 110. For example, as illustrated in FIGS. 9 and 10, the sliding movement of the first side frame 120 may be prevented by forming a fixing groove 141 on the bottom of the main body part 110, and arranging a latch 143 that slides vertically on the first side frame 120. More specifically, as the latch 143 is inserted into the fixing groove 141, the sliding movement of the first side frame 120 may be prevented. The fixing groove 141 may be formed in the form of an inverted cone, and this shape may facilitate insertion of the latch 143. A plurality of fixing grooves 141 may be formed, and slide movement may be prevented even when the first side frame 120 is rotated.

Figure 11:
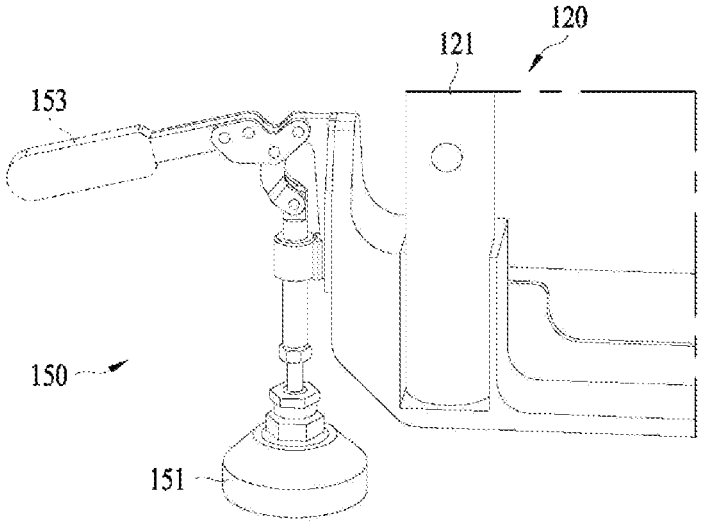
FIG. 11 is a view illustrating a second fixing part of the variable exercise apparatus according to an example embodiment of the present disclosure.

FIG. 11 is a view illustrating a second fixing part 150 of the variable exercise apparatus 100 according to an example embodiment of the present disclosure.

As described above, after the first side frame 120 according to another example embodiment projects from the main body part 110, the first side frame 120 may rotate about the main body part 110 as an axis in the vertical direction. For example, as illustrated in FIG. 6, the first side frame 120 and the second side frame 130 projecting from the main body part 110 may rotate to approach each other. However, when the first side frame 120 is fixed, the user may stably perform the exercise.

Therefore, in an example of the present disclosure, arranging the second fixing part 150 may prevent the first side frame 120 from rotating. For example, as illustrated in FIG. 11, a material having a high frictional force, such as a rubber material, may be arranged to move up and down by a lever 153. The second fixing part 150 may prevent the rotation of the first side frame 120 through frictional force by pressing a rubber fixing foot 151 toward the floor through the lever 153.

Figure 12:
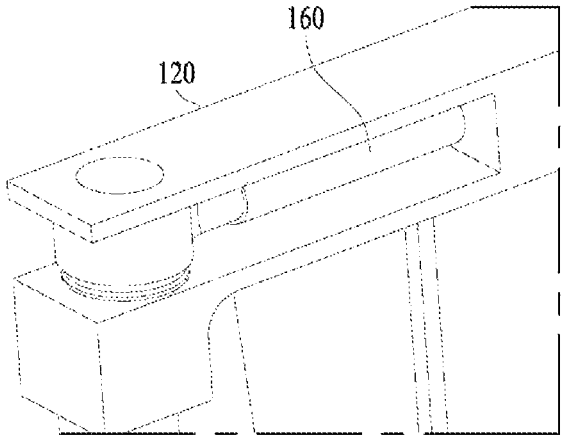
FIG. 12 is a view illustrating a state in which the pull up handle of the variable exercise apparatus is accommodated according to an example embodiment of the present disclosure.
Figure 13:
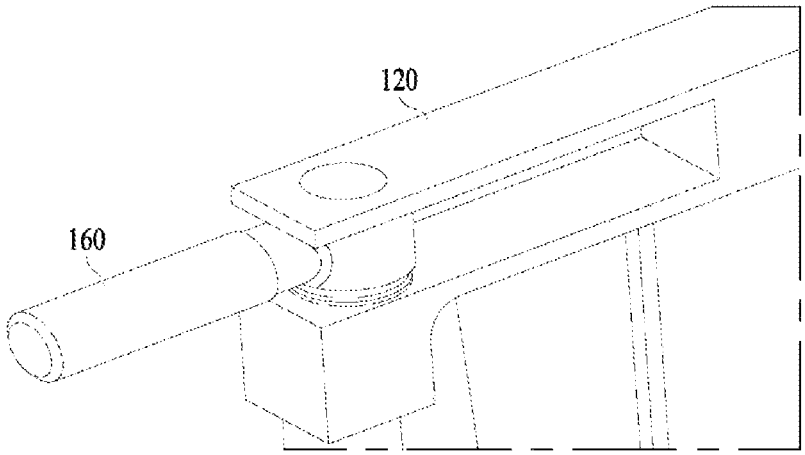
FIG. 13 is a view illustrating a state in which the pull up handle of the variable exercise apparatus is extended according to an example embodiment of the present disclosure.

FIG. 12 is a view illustrating a state in which a pull up handle 160 of the variable exercise apparatus 100 is accommodated according to an example embodiment of the present disclosure, and FIG. 13 is a view illustrating a state in which the pull up handle 160 of the variable exercise apparatus 100 is extended according to an example embodiment of the present disclosure.

The pull up handle 160 may be installed on the first side frame 120 and the second side frame 130, respectively, and the pull up handles 160 may be installed at the front ends of the first side frame 120 and the second side frame 130 to rotate in the vertical direction of the main body part 110 as an axis. When the pull up handles 160 are accommodated and the first side frame 120 and the second side frame 130 are accommodated inside the main body part 110 (for example, the first state), the first side frame 120 and the second side frame 130 may not be exposed externally. When the pull up handles 160 are extended and projected, the user may perform an exercise such as a pull-up. Specifically, since the first side frame 120 and the second side frame 130 may rotate to approach or move away from each other, the distance between the pull up handles 160 may also be adjusted.

Figure 14:
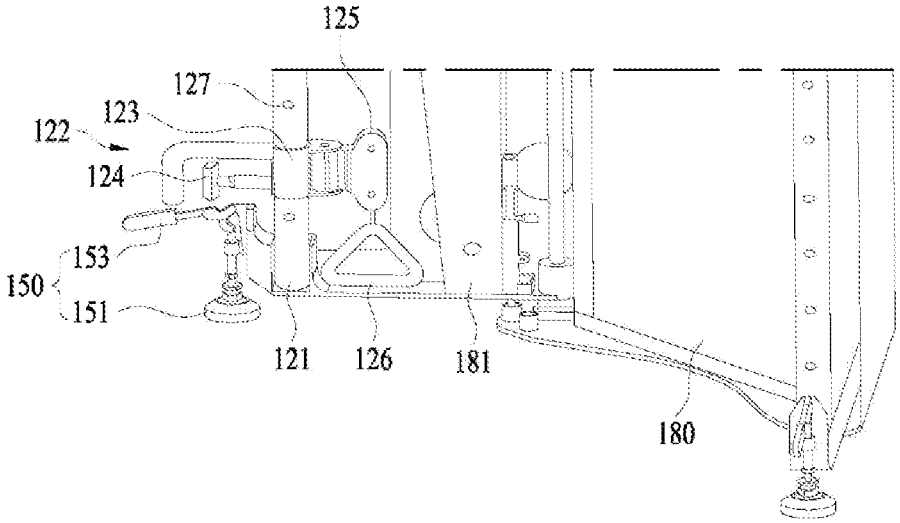
FIG. 14 is a view illustrating a state in which the first handle of the variable exercise apparatus is accommodated.

FIG. 14 is a view illustrating a lower end of the variable exercise apparatus 100 according to an example embodiment of the present disclosure, and illustrating a state in which the first handle 122 is accommodated.

Since the first side frame 120 according to the example embodiment is accommodated by sliding into the main body part 110, it needs to be arranged so as not to interfere with surrounding structures during the slide movement process. Therefore, the first side frame 120 has a seating part on which the first gripping part 126 may be fixedly arranged to prevent interference with surrounding structures when the first side frame 120 is accommodated.

It will be apparent to those skilled in the art that various modifications and variations can be made in the present disclosure without departing from the spirit or scope of the disclosure.

The above detailed description should not be construed as restrictive in all respects and should be considered as illustrative. The scope of the present disclosure should be determined by reasonable interpretation of the appended claims, and all modifications within the equivalent scope of the present disclosure are included in the scope of the present disclosure.

The invention claimed is:

1. A variable exercise apparatus comprising:

a main body part that is polygonal prismatic, and comprises a driving part configured to generate an exercise load;

a first side frame that is arranged to be accommodated in or drawn out from the main body part by sliding, and configured to rotate with respect to the main body part when drawn out from the main body part; and a second side frame that is arranged to be symmetric with the first side frame about the main body part, wherein the first side frame comprises:

a first handle adjustment pillar that is arranged in a vertical direction; and a first handle configured to move along the first handle adjustment pillar.

2. The variable exercise apparatus of claim 1, wherein the first side frame comprises a first fixing part configured to fix the first side frame by preventing the sliding with respect to the main body part.

3. The variable exercise apparatus of claim 2, wherein the first side frame comprises a second fixing part configured to fix the first side frame by preventing rotating with respect to the main body part.

4. The variable exercise apparatus of claim 3, wherein the main body part comprises a cross-sectional shape that is in a form of a right isosceles triangle, and wherein the first side frame and the second side frame are drawn out or accommodated in along both edges forming a right angle at a vertex portion forming an acute angle.

5. The variable exercise apparatus of claim 4, wherein the first side frame and the second side frame, when drawn out from the main body part, rotate to approach each other or move away from each other.

6. The variable exercise apparatus of claim 1, wherein the first side frame further comprises a pull up handle that is rotatable about the first handle adjustment pillar, and projects from or is accommodated in the first side frame.

7. The variable exercise apparatus of claim 1, wherein the first handle adjustment pillar comprises a plurality of joining holes formed at equal intervals in a longitudinal direction, and wherein the first handle comprises a joining protrusion that is projected toward the first handle adjustment pillar or accommodated.

8. The variable exercise apparatus of claim 7, wherein the plurality of joining holes are formed on an outer peripheral surface of the first handle adjustment pillar to be spaced apart from each other in a circumferential direction of the first handle adjustment pillar.

9. The variable exercise apparatus of claim 8, wherein the first handle comprises:

a handle body that is inserted into the first handle adjustment pillar to move;

a handle adjusting part that is installed on the handle body to insert or draw the joining protrusion into the joining holes; and a pulley part that projects from the handle body and is connected to the driving part of the main body part to receive an exercise load.

10. The variable exercise apparatus of claim 9, where the handle adjusting part and the pulley part are arranged in opposite directions to each other with respect to the handle body, and wherein the first handle further comprises a first gripping part connected to the driving part of the main body part through the pulley part.

11. The variable exercise apparatus of claim 1, wherein the main body part further comprises a camera that is arranged between the first side frame and the second side frame.

12. The variable exercise apparatus of claim 1, wherein the main body part further comprises a one-way transparent mirror arranged on a surface between the first side frame and the second side frame.

13. The variable exercise apparatus of claim 12, wherein the main body part further comprises a display that is arranged on a rear surface of the one-way transparent mirror.

* * * * *